United States Patent [19]

Hicks

[11] 4,449,697

[45] May 22, 1984

[54] MULTIPLE DRUM WINCHES

[75] Inventor: Raymond J. Hicks, Llandrindod Wells, Great Britain

[73] Assignee: Hicks Transmissions Limited, Powys, Great Britain

[21] Appl. No.: 359,711

[22] PCT Filed: Jul. 2, 1981

[86] PCT No.: PCT/GB81/00121

§ 371 Date: Mar. 2, 1982

§ 102(e) Date: Mar. 2, 1982

[87] PCT Pub. No.: WO82/00133

PCT Pub. Date: Jan. 21, 1982

[30] Foreign Application Priority Data

Jul. 3, 1980 [GB] United Kingdom ..... 8021899

[51] Int. Cl.[3] ..... B65D 1/74

[52] U.S. Cl. ..... 254/297; 254/901

[58] Field of Search ..... 254/297, 901

[56] References Cited

U.S. PATENT DOCUMENTS

| | | | |
|---|---|---|---|
| 3,376,020 | 4/1968 | KLINKE | 254/297 |
| 3,460,807 | 12/1969 | Prikhodko et al. | 254/297 |
| 3,788,607 | 1/1974 | Crooks | 254/901 |
| 3,834,673 | 10/1974 | Alexander | 254/295 |
| 3,843,097 | 10/1974 | Noly | 254/297 |
| 4,143,855 | 3/1979 | Burton | 254/901 |
| 4,236,696 | 2/1980 | Hicks | 254/297 |

FOREIGN PATENT DOCUMENTS

| | | |
|---|---|---|
| 2521396 | 11/1976 | Fed. Rep. of Germany . |
| 1127769 | 9/1968 | United Kingdom . |
| 1167662 | 10/1969 | United Kingdom . |

*Primary Examiner*—John M. Jillions

*Attorney, Agent, or Firm*—Young & Thompson

[57] ABSTRACT

A multiple drum winch is driven by epicyclic differential gearing. One drum (1) rotates with the planet carrier (29, 55) and another drum (2) rotates with the annulus (35, 59) to which it is directly geared, the input being to the sun (27, 53), possibly via reduction gearing (50, 51). The epicyclic can be housed within one of the drums (1). The gear ratios are selectable to achieve a balance between the power requirements of the drums. The drums are journalled only at intermediate zones (22, 23) spanning the centroid of the expected load.

7 Claims, 4 Drawing Figures

MULTIPLE DRUM WINCHES

This invention relates to multiple drum winches.

For many applications a single drum winch is inadequate, and there have been developed several kinds of multiple drum winches which afford greater power, better control, and a kinder lead for the wire. However, the problem is to ensure that the load is properly shared between the drums, which of course have to rotate at related speeds. Generally, the drum around which the first turn is taken is likely to be under the greater load, and will therefore require the greater power.

Hitherto, the practice has often been to drive the capstan drums from a single motor and to use some form of splitter gear or otherwise "strap" the drums together for uniform rotation. However, the unequal loading on the drums means an asymmetrically loaded gear train. An alternative has been to provide separate motors for each drum, but as a result of the different loads there tend to be different speeds of rotation, and usually the drums still have to be strapped together.

The aim of this invention is to avoid the expense and complexity of multiple motors and associated gears, and to drive the drums from a single motor through a simple gear system which fairly distributes the load.

According to the present invention there is provided a multiple drum winch wherein the drive to the drums is through a differential gear train, the rotation of one drum being tied to that of a carrier of an intermediate gear and the rotation of another drum being tied to that of another, non-input gear.

With this differential coupling between the drums, no gear need be rotationally fixed and the gear ratios can be chosen to achieve a suitable balance between the power requirements from the respective drums. The expected co-efficient of friction can be known to within quite narrow limits and be used in determining the gear ratios.

In the preferred form, the drive is to the sun of an epicyclic train, the planet carrier is fixed to said one drum, and the annulus of the epicyclic is geared to the other drum. The epicyclic can be housed within said one drum, or within a fixed mounting for the drums, where there may also be reduction gearing at the input to enable a high speed motor to be used.

Conveniently the drums are carried by bearings located internally at an intermediate load balancing zone, which would be approximately one third of the axial distance of the drum from the end at which the first turn of the cable is taken. Bearings at the ends of the drums would not be necessary.

For a better understanding of the invention one embodiment will now be described, by way of example, with reference to the accompanying drawings, in which.

Figure 1:
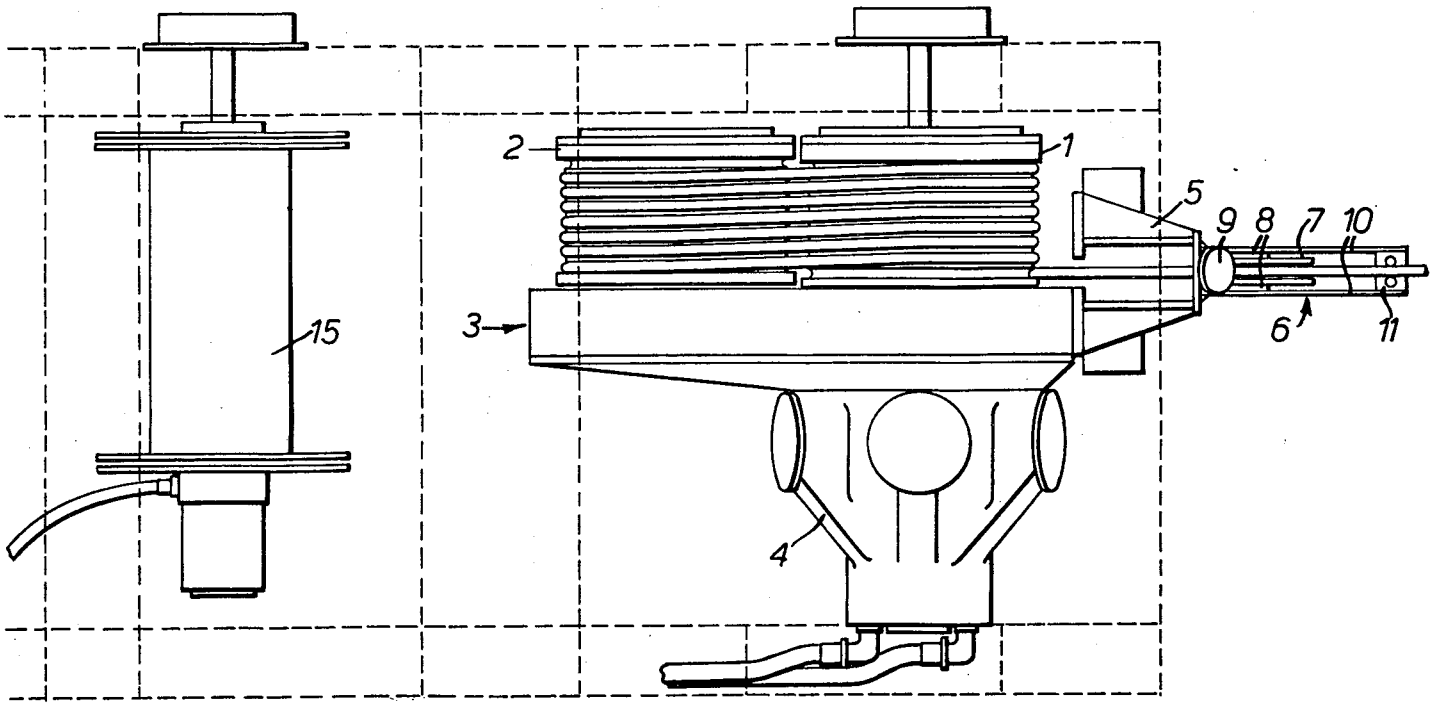
FIG. 1 is a plan view of a twin capstan winch.
Figure 2:
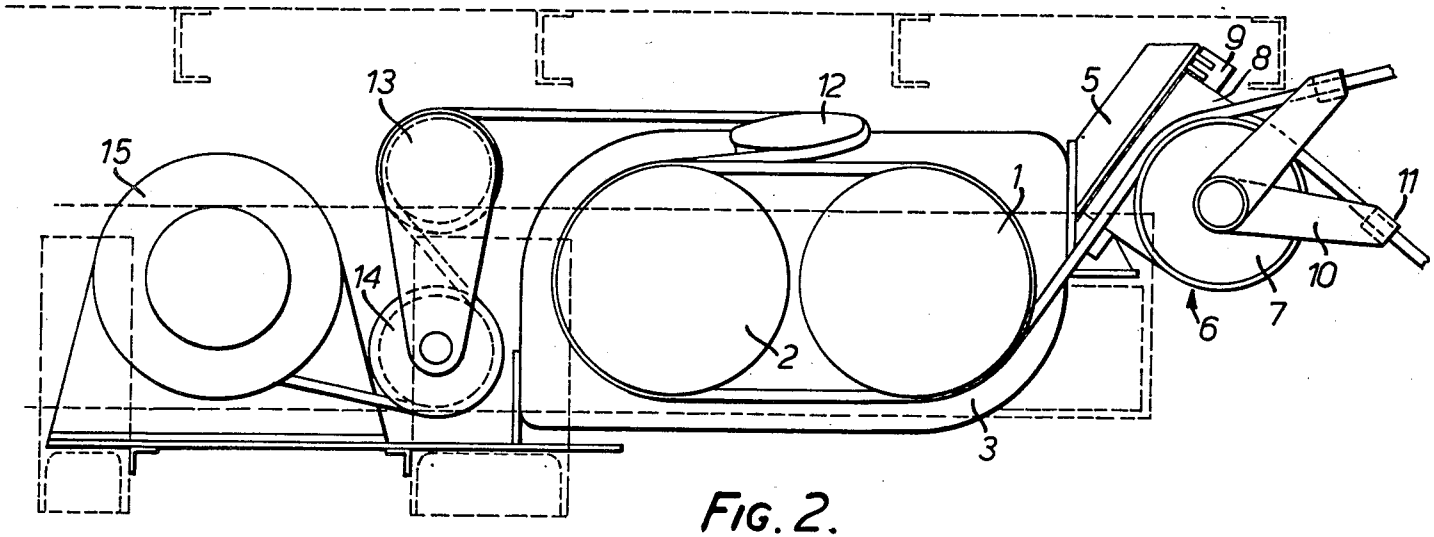
FIG. 2 is a side view of the winch of FIG. 1.

The general arrangement is shown in FIGS. 1 and 2 where two grooved capstan drums 1 and 2 are mounted on a base 3 and are driven by a hydraulic motor 4. Attached to one end of the base is an upwardly angled bracket 5 below which is pivoted a fairlead assembly 6. This consists of a pulley wheel 7 rotatable between two parallel plates 8 which are fixed to part of a hinge 9 along the sloping underside of the bracket 5. Two arms 10 extend from the axis of the wheel 7 to beyond its radius, where they are joined by a deadeye or bush 11. These arms can swing between two extreme positions, as indicated in FIG. 2, about the axis of the wheel 7, the passage through the deadeye being aligned tangentially with the circumference of the wheel. Thus a wire is guided truely on to the wheel from a wide compass by virtue of the hinge 9 and the swinging arms 10. The wire leaves the wheel 7 and after one turn around the first drum 1 continues around both drums until taken off via further guide pulleys 12, 13 and 14 to a take-up drum 15, by which time it will only be under light tension. The drive to the drum 15 can be coupled differentially via a hydraulic or electric motor to the drive for the drums 1 and 2. There will be failsafe brakes for both the take-up drum 4 and the capstans, operating on hydraulic failure for example.

Figure 3:
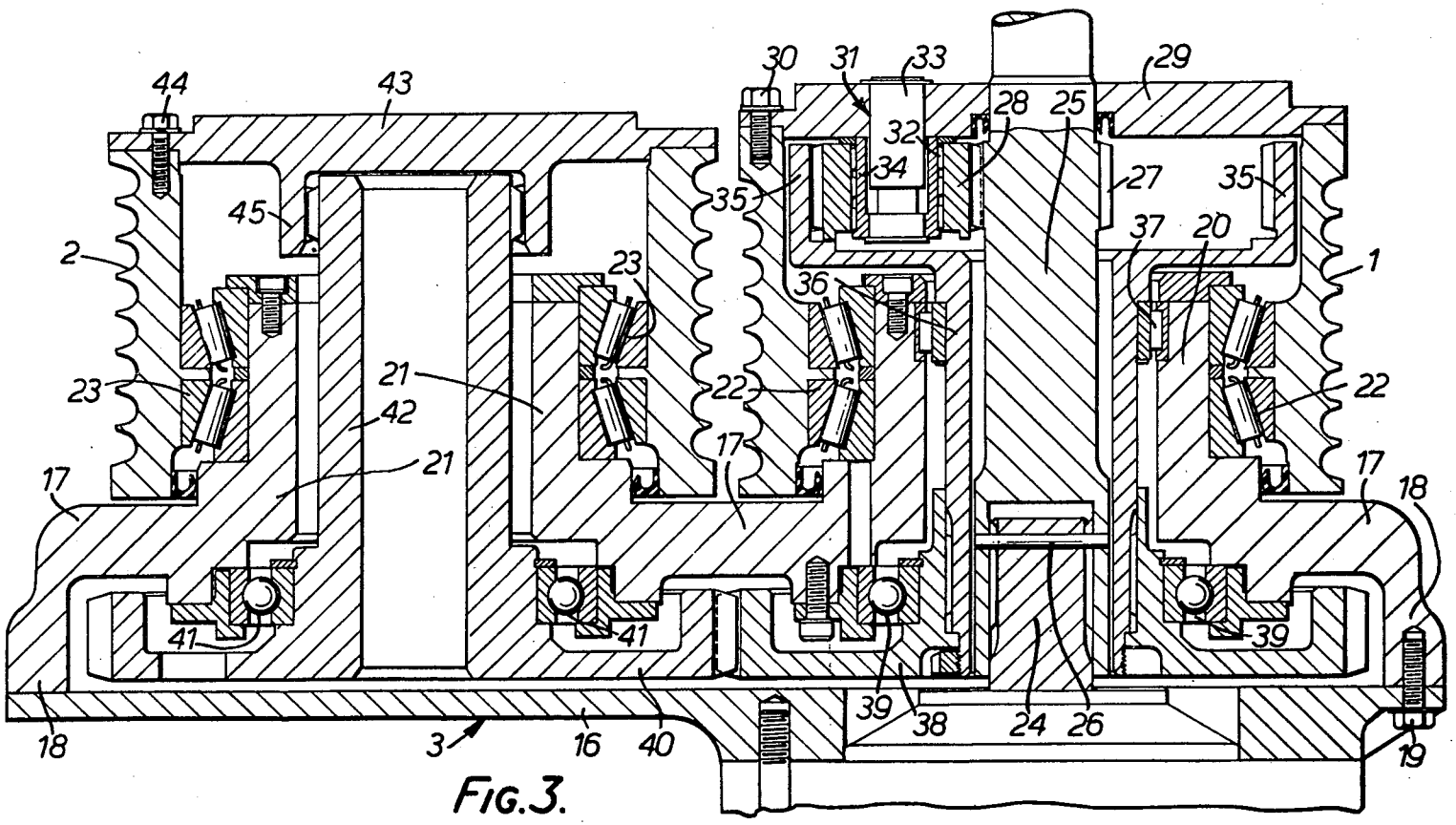
FIG. 3 is a longitudinal section through the two capstans of the winch.

Referring now to FIG. 3, the base 3 comprises a base plate 16 and a body 17 which provides a gear housing and mountings for both drums 1 and 2. The body 17 is of oblong form and has a skirt 18 which seats around the periphery of the plate 16 to be secured by bolts 19. It thus forms a shallow chamber with the plate 16, but projecting outwardly from it are two parallel, hollow cylindrical formations 20 and 21. These are, in effect, fixed pins on which the drums 1 and 2 are respectively journalled by double roller bearings 22 and 23. The axial centre of each of these bearings is approximately one third of the axial distance of the associated drum from that end of the drum nearest the base, which is where the first turn of the cable is taken. Since the load is much greater at that end, and decreases progressively towards the other end, the centroid of the load will be off centre towards the base. By positioning the bearings of the drums to embrace that centroid, there is no need to provide bearings at the ends. This is simple and economical and facilitates the arrangement of the gear system to be described.

The drive is applied from a stub shaft 24 which is splined into the hollow end of a main drive shaft 25, the two shafts being secured against mutual axial movement by a transverse pin 26. Near the other end of the shaft 25 a pinion 27 is formed, which provides the sun gear of an epicyclic train. Planets 28 (only one of which is shown) are carried by an end plate 29 secured to drum 1 by bolts 30. Each planet is mounted on a flexible stud assembly 31 through needle bearings 32. Each flexible stud assembly consists of a pin 33 projecting inwardly from the carrier plate 29 and formed with a neck or reduced diameter portion towards its free end. A sleeve 34 is fitted to the extreme end of th pin and is cantilevered back towards the plate 29. The flexibility that this provides allows for automatic load sharing in accordance with known techniques.

The annulus 35 for the epicyclic is a large diameter portion of a stepped tubular member 36, whose lesser diameter portion extends from the epicyclic back towards the base plate 16, surrounding the shaft 25 and within the cylindrical formation 20 of the body 17. At an intermediate point it is journalled within that formation 20 by a roller bearing 37.

The end of the sleeve member 36 adjacent the base is externally splined, and is thereby united to a gear 38. This gear is rotatably supported by a ball journal bearing 39 and it rotates within one end of the shallow chamber formed by the body 17 and its base plate 16.

The gear 38 meshes with another gear 40 rotatably supported at the other end of the chamber by a further ball journal bearing 41. The gear 40 is formed at one end of a hollow cylindrical member 42 which extends freely through the cylindrical formation 21 to terminate adjacent a plate 43 secured by bolts 44 to the end of the drum 2. This other end of the member 42 is externally splined to engage splines on the inside of an annular rib formation 45 on the inside of the drum end plate 43.

In operation, the drum 1 will be driven in unison with the planet carrier 29, the orbiting of the planets being determined by the drive from the sun 27 and the reaction provided by the annulus 35. The latter is positively coupled via 36, 38, 40, 42, 45 and 43 to the drum 2. Thus there is a differential coupling between the two drums. It follows that from the single input there is twice the gear ratio that would be obtainable by simply duplicating the epicyclic gear system for each drum and having two fixed annuli, while the torque on the pinion 27 will only be half what it would be with such an arrangement, although it will have to rotate at twice the speed to achieve the same rate of winding.

It will be understood that it is not essential to have the gears 38 and 40 of equal size. According to the application intended, the friction and loads expected, various gear ratios can be employed. It is not even essential to have drums of similar size.

Figure 4:
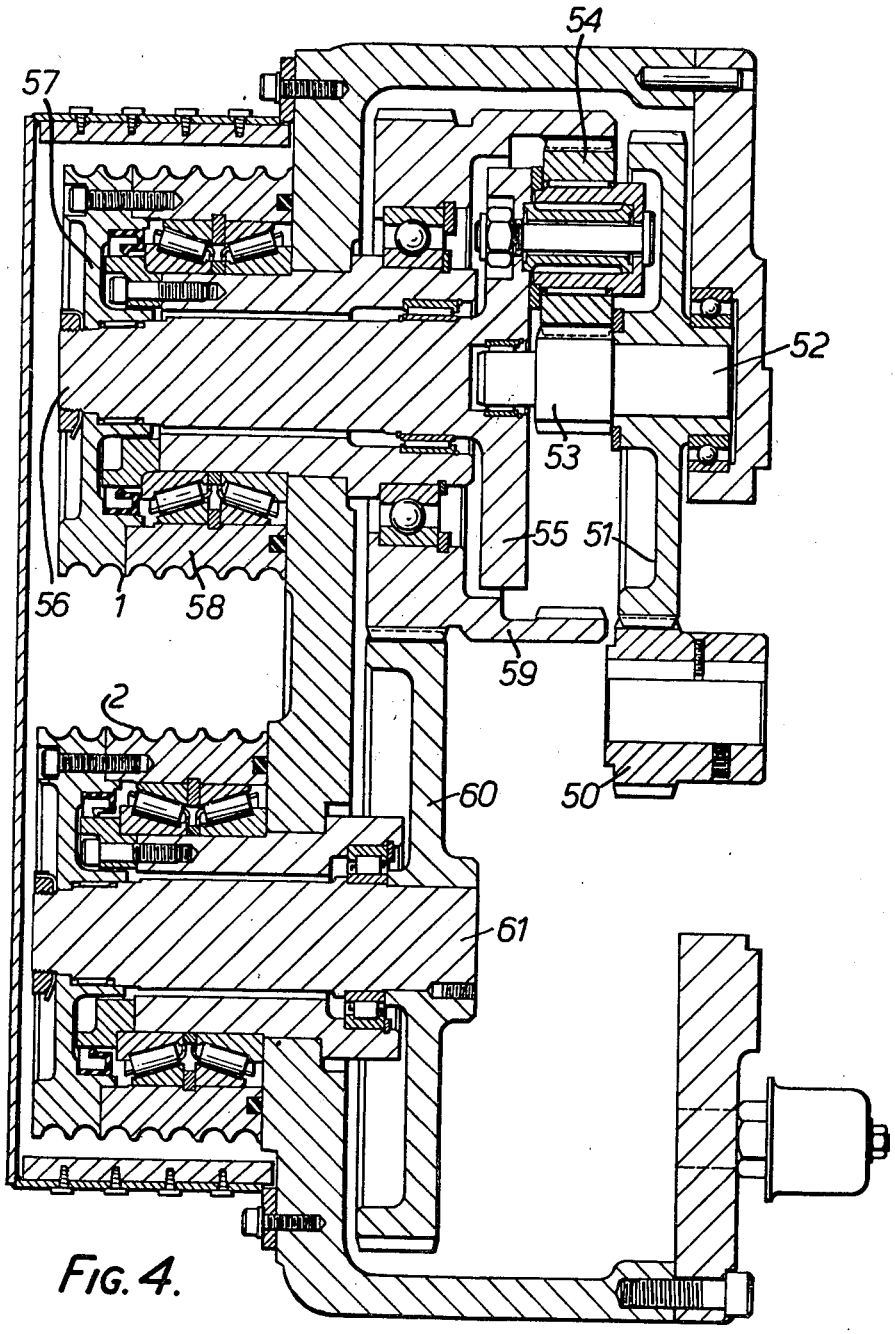
FIG. 4 is a longitudinal section through another winch.

The winch of FIG. 4 operates on the same principles but with a different position of the epicyclic and the addition of a reduction gear which enables a much higher speed driving motor to be used. The epicyclic is no longer inside one of the drums (still referenced 1 and 2) and so more flexibility is possible in its design, since it is not constrained in volume. Also, the drums can now be made substantially the same, giving some economy.

In more detail, the drive is applied to a pinion 50 which meshes with a large diameter gear 51 journalled to the base plate and fitted to a short shaft 52 whose intermediate portion forms the sun 53 of an epicyclic gear train. One of the planets is indicated at 54 and its mounting to a carrier 55 is similar to the arrangement of FIG. 3. The carrier 55 is a disc-like portion at the end of a shaft 56, which at one end rotatably receives the free end of the shaft 52, and which at the other end is splined to a member 57 forming part of the first grooved drum 1. The other drum part is indicated at 58. Therefore this drum is effectively integral with the planet carrier of the epicyclic.

The annulus 59 of the epicyclic is journalled on part of the base body, and meshes with a gear 60 fixed to one end of a shaft 61 splined at its other end to part of the second drum 2. Thus, this second drum is effectively in mesh with the annulus of the epicyclic, and there is the same kind of differential coupling of the drums as in FIG. 3.

It will be seen that the drums are again journalled at an intermediate zone, offset towards one end. There are certain detailed differences of construction, such a the formation of the base body in several parts, and in the provision of a casing over the drums, but these will be evident by inspection of the FIG.

I claim:

1. A multiple drum winch comprising a base, two parallel drums carried side by side on the base for entrainment by a common cable, an input shaft, a sun gear on the input shaft co-axial with the first drum, planet pinions carried by the first drum meshing with the sun gear, an internally toothed annulus mounted co-axially with the first drum and meshing with the planet pinions, and a positive transmission between the second drum and said annulus.

2. A winch as claimed in claim 1, wherein the drums are journalled solely on bearings at an intermediate zone along their axial length.

3. A winch as claimed in claim 2, wherein the intermediate zone is approximately one third of the axial length from the end designed to take the first turn of the cable.

4. A winch as claimed in claim 2, wherein the base provides two fixed gudgeons on which the drums are journalled, the drive to the drums being via shafts extending co-axially through these gudgeons.

5. A winch as claimed in claim 4, wherein the shaft through the gudgeon for the first drum is the input shaft, the sun gear is on the end thereof projecting beyond said gudgeon, the planet pinions are mounted within said first drum on an end plate thereof, and the annulus is on one end of a generally cylindrical member surrounding said input shaft and extending through said gudgeon, the other end being coupled to the shaft for the other drum.

6. A winch as claimed in claim 5, wherein said other end of the annulus member is directly geared to the shaft for the other drum.

7. A winch as claimed in claim 4, wherein the shaft through the gudgeon for the first drum is attached to that drum beyond the end of the gudgeon, and the other end of the shaft carries the planet pinions below or within the base, where are also the sun gear and the annulus.

* * * * *